US010625287B2

(12) United States Patent
Ding

(10) Patent No.: US 10,625,287 B2
(45) Date of Patent: Apr. 21, 2020

(54) ANTI-LOOSENING EMULSION PUMP

(71) Applicant: Yao Wu Ding, Taixing (CN)
(72) Inventor: Yao Wu Ding, Taixing (CN)

( * ) Notice: Subject to any disclaimer, the term of this patent is extended or adjusted under 35 U.S.C. 154(b) by 5 days.

(21) Appl. No.: 15/127,171
(22) PCT Filed: Aug. 21, 2014
(86) PCT No.: PCT/CN2014/084889
§ 371 (c)(1),
(2) Date: Feb. 6, 2019
(87) PCT Pub. No.: WO2015/143828
PCT Pub. Date: Oct. 1, 2015

(65) Prior Publication Data

US 2019/0193099 A1 Jun. 27, 2019

(30) Foreign Application Priority Data

Mar. 28, 2014 (CN) ..... 2014 1 0122672

(51) Int. Cl.
*B05B 11/00* (2006.01)

(52) U.S. Cl.
CPC ..... *B05B 11/306* (2013.01); *B05B 11/0091* (2013.01); *B05B 11/3023* (2013.01); *B05B 11/3047* (2013.01)

(58) Field of Classification Search
CPC ..... B05B 11/306; B05B 11/0091; B05B 11/3023; B05B 11/3047; B65D 41/0471
(Continued)

(56) References Cited

U.S. PATENT DOCUMENTS 3,884,392 A * 5/1975 Hazard ..... B65D 47/305 222/153.14
3,907,174 A * 9/1975 Steiman ..... B05B 11/3001 222/153.13
(Continued)

FOREIGN PATENT DOCUMENTS

CN 2522177 Y 11/2002
CN 2598924 Y 1/2004
(Continued)

OTHER PUBLICATIONS

State Intellectual Property Office of the People's Republic of China Office Action dated Oct. 27, 2016 for Chinese Patent Application No. CN201510811108.3, International Filing Date: Mar. 28, 2014, consisting of 6-pages.
(Continued)

*Primary Examiner* — Benjamin R Shaw
(74) *Attorney, Agent, or Firm* — Christopher & Weisberg, P.A.

(57) ABSTRACT

An anti-loosening emulsion pump comprises a press head, a toothed sleeve, a cylinder and a piston rod, wherein the press head and the toothed sleeve are respectively provided with standing tooth pieces and standing tooth blocks interacting with each other. When the press head is rotated in a locking direction, the standing tooth pieces can move beyond the standing tooth blocks, and when the press head is rotated in an opening direction, the standing tooth pieces and the standing tooth blocks interact with each other, the rotation of the press head can be prevented. The press head of the anti-loosening emulsion pump further includes a press mouth which is movable relatively. The anti-loosening emulsion pump of the present invention can prevent the press head from being open due to such reasons as impact and the like, and can prevent the toothed sleeve from loosening from the opening of the container.

22 Claims, 12 Drawing Sheets

(58) Field of Classification Search
USPC ..... 222/321.9, 147, 257, 320; 215/263, 201, 215/330
See application file for complete search history.

(56) References Cited

U.S. PATENT DOCUMENTS

| | | | | | |
|---|---|---|---|---|---|
| 4,281,778 | A * | 8/1981 | Stull | B65D 47/148 | 215/214 |
| 4,345,691 | A * | 8/1982 | Burke | B05B 11/3045 | 215/216 |
| 4,836,423 | A * | 6/1989 | Hayes | B05B 11/0032 | 222/145.3 |
| 5,169,033 | A * | 12/1992 | Shay | B05B 11/3045 | 215/216 |
| 5,360,127 | A * | 11/1994 | Barriac | B05B 11/0008 | 215/263 |
| 5,482,187 | A * | 1/1996 | Poulsen | B05B 11/0054 | 222/207 |
| 5,875,936 | A * | 3/1999 | Turbett | B05B 11/00412 | 222/207 |
| 5,938,081 | A * | 8/1999 | Foster | B65D 41/0471 | 222/153.09 |
| 6,604,656 | B1 * | 8/2003 | Tseng | B05B 11/306 | 222/153.13 |
| 9,687,866 | B1 * | 6/2017 | Chan | B05B 11/3047 | |
| 2004/0062667 | A1 * | 4/2004 | Ding | B05B 11/3047 | 417/435 |
| 2005/0173461 | A1 * | 8/2005 | Law | B05B 11/306 | 222/321.9 |
| 2006/0049208 | A1 | 3/2006 | Daansen | | |
| 2008/0006656 | A1 * | 1/2008 | Tseng | B05B 11/3023 | 222/321.9 |
| 2010/0006606 | A1 * | 1/2010 | Lee | B05B 11/0094 | 222/383.1 |
| 2013/0313287 | A1 * | 11/2013 | Walsh | B65D 1/0246 | 222/251 |
| 2014/0144945 | A1 * | 5/2014 | Jung | B05B 11/0032 | 222/320 |
| 2014/0314600 | A1 * | 10/2014 | Ding | B05B 11/3023 | 417/437 |
| 2017/0128966 | A1 * | 5/2017 | Law | B05B 11/0027 | |
| 2017/0144178 | A1 * | 5/2017 | Deng | B65D 41/62 | |
| 2018/0148236 | A1 * | 5/2018 | Flood | B65D 49/00 | |
| 2019/0009291 | A1 * | 1/2019 | Santagiuliana | B05B 11/0094 | |
| 2019/0015860 | A1 * | 1/2019 | Arminak | B05B 11/3059 | |

FOREIGN PATENT DOCUMENTS

| | | | |
|---|---|---|---|
| CN | 101583544 | A | 11/2009 |
| CN | 202089379 | U | 12/2011 |
| CN | 102452523 | A | 5/2012 |
| CN | 103339034 | A | 10/2013 |
| CN | 103879653 | A | 6/2014 |
| CN | 203753609 | U | 8/2014 |
| JP | 2511640 | Y2 | 7/1996 |
| JP | 2528740 | Y2 | 12/1996 |
| JP | 11-278525 | A | 10/1999 |
| JP | 11278525 | A | 10/1999 |
| JP | H11278525 | A | 10/1999 |
| JP | 2003-165564 | A | 6/2003 |
| JP | 2003-191995 | A | 7/2003 |

OTHER PUBLICATIONS

Notice of Rejection dated Oct. 3, 2017, for corresponding Japanese Application No. 2016-559572; Filing Date: Sep. 26, 2017 consisting of 3-pages.

International Search Report and Written Opinion dated Jan. 4, 2015 for International Application Serial No. PCT/CN2014/084889, International Filing Date: Aug. 21, 2014, consisting of 10 pages.

1st Chinese Search Report in both Chinese and its English translation dated Jun. 25, 2015 for corresponding Chinese Application Serial No. CN 201410122672.X, Chinese Filing Date: Mar. 28, 2014, consisting of 4 pages.

* cited by examiner

ANTI-LOOSENING EMULSION PUMP

CROSS-REFERENCE TO RELATED APPLICATIONS

This application is a Submission under 35 U.S.C. 371 for U.S. National Stage Patent Application of, and claims priority to, International Application Number PCT/CN2014/084889, filed Aug. 21, 2014, entitled "ANTI-LOOSENING LOTION PUMP", which is related to and claims priority to Chinese Application Number CN 201410122672.X, filed Mar. 28, 2014, the entire contents of both of which are hereby incorporated herein by reference.

TECHNICAL FIELD

The present invention relates to an emulsion pump, and more particularly to an anti-loosening emulsion pump. The emulsion pump is specifically a press type emulsion pump.

BACKGROUND

Generally, an emulsion pump is mounted on a container opening of a bottled product such as body lotion, shampoo and the like. A user may press the emulsion pump to pump out the product in the container. FIGS. 16*a* and 16*b* show an emulsion pump presently commonly used. FIG. 16*a* is a sectional view showing interior structure of the emulsion pump.

As shown in FIG. 16*a*, the emulsion pump 100 includes a press head 110 with an outlet, a toothed sleeve 120 and a cylinder 130. The toothed sleeve 120 threadedly connects to the opening of a container (not shown), and thus connects the emulsion pump 100 to the container. An end of the cylinder 130 is connected to the toothed sleeve 120, and the other end thereof extends into the container. The emulsion pump 100 is further provided with a piston rod 140, one end of which is fixedly connected to the press head 120, and the other end thereof extends into the cylinder 130. The interior of the piston rod 140 is fluidly communicated with the outlet of the press head 110.

A first spring seat 151 is provided at a lower portion of the piston rod 140, and a second spring seat 152 is provided in the cylinder 130 correspondingly, a compression spring 150 is supported between the first spring seat and the second spring seat 152. The compression spring 150 exerts an upwardly biasing force on the piston rod 140.

As shown in FIG. 16*a*, the press head 110 and the toothed sleeve 120 are respectively provided with complementary internal and external threads, the press head 110 may be fixed on a locked position with the internal and external threads engaged. The press head 110 may transited from the locked position to an opening position by rotating the press head 110 in an open direction (a counter-clockwise direction) shown by an arrow in FIG. 16*b*. At the opening position, the piston rod 140 moves upwardly by means of the biasing force of the compression spring 150, and thus the press head 110 moves upwardly.

The cylinder 130 is provided with a first valve 160, and a piston head 170 is provided at the bottom portion of the piston rod 140, the piston head 170 forms a check valve with a corresponding piston. The first valve 160 is also a check valve, and the flow direction thereof is identical to that of the check valve at the piston head 170. When the press head 110 and the piston rod 140 are at the opening position, the user may press the press head 110 downward against the biasing force of the spring 150. At this time, a space between the first valve 160 and the piston rod 140 is reduced, so that the pressure therein raises, by means of which, the product between the first valve 160 and the piston rod 140 flows into the interior of the piston rod 140, and is discharged through the outlet of the press head 110. Upon the press on the press head 110 by the user being releasing, the piston rod 140 moves upwardly together with the press head 110 by means of the upwardly biasing force of the press head 110, at this time, the space between the first valve 160 and the piston rod 140 expands, during which the piston moves downward relative to the piston head 170 with the friction force applied by the cylinder to the piston, and thus closes the corresponding check valve. At this time, the pressure between the first valve 160 and the piston rod 140 decreases, and by means of such differential pressure, the first valve 160 opens, and thus allows the liquid in the container to flow into the space between the first valve 160 and the piston rod 140.

Nowadays, with the fast development of the E-commerce, the existing emulsion pump presents some problems. Specifically, during transportation of the bottled product by express delivery, a tubular press mouth of the emulsion pump may undergo torque due to some reasons such as impact, drop and the like, thus resulting rotation of the press head. If the press head rotates in the opening direction, i.e. the counter-clockwise direction, it is possible that the press head may be turned to its opening position, and thus springs up. At this time, if the press head is pressed downward, the liquid in the container may be pumped out. Also, the direction of the thread connection between the toothed sleeve and the container is identical to that of the thread connection between the press head and the toothed sleeve, that is, when the press head rotates in the opening direction, i.e. the counter-clockwise direction, by means of the torque exerted on the press mouth, it is possible that the toothed sleeve loosens from the opening of the container, resulting in leakage of liquid from the container. Furthermore, no matter the press mouth is exerted by a torque in the counter-clockwise direction or clockwise direction, there is a risk of the press mouth being broken by impact.

So, there is a need for a novel emulsion pump used for a bottled product, which can overcome the aforementioned problems.

SUMMARY OF THE INVENTION

The present invention is made in view of the aforementioned problems of the emulsion pump in the prior art. The purpose of the present invention is for providing an emulsion pump that can prevent the emulsion pump from loosening during transportation due to such reasons as impact and drop and the like, and thus from liquid leakage, and also can prevent the press mouth of the emulsion pump from being broken.

The aforementioned purpose of the present invention can be realized by an anti-loosening emulsion pump comprising a press head including a press mouth; a toothed sleeve connected to an opening of a container mounted with the anti-loosening emulsion pump; a cylinder, an upper end of which is connected to the toothed sleeve and the other end of which extends into the container; a piston rod, an upper end of which is connected to the press head, and a lower end of which extends into a space within the cylinder, with a bore of the piston rod being communicated with an outlet of the press mouth; at least one first standing tooth piece provided at one of an inner surface of a press head sleeve of the press head and an outer surface of the toothed sleeve, which includes a first guide surface extending from the one of the inner surface of the press head sleeve and the outer surface of the toothed sleeve in an opening direction of the press head and forming an angle with a tangential direction of the press head or of the toothed sleeve, and a first stop surface provided at a side of the first standing tooth piece opposite to the first guide surface and forming an angle with the tangential direction of the press head or of the toothed sleeve; and at least one first standing tooth block provided at other one of the inner surface of the press head sleeve of the press head and the outer surface of the toothed sleeve, which includes a second guide surface extending from the other one of the inner surface of the press head sleeve and the outer surface of the toothed sleeve in a locking direction of the press head and forming an angle with the tangential direction of the press head or of the toothed sleeve and a second stop surface provided at a side of the first standing tooth block opposite to the first guide surface and forming an angle with the tangential direction of the press head or of the toothed sleeve, wherein a radius of an inscribed circle of the first standing tooth piece is less than a radius of a circumcircle of the first standing tooth block, thereby an interference fit is formed between the first standing tooth piece and the first standing tooth block; and an internal thread and a first smooth surface are provided on the inner surface of the press head sleeve of the press head; an external thread and a second smooth surface are provided on an outer surface of the toothed sleeve, the internal thread, the external thread, the first smooth surface and the second smooth surface are provide in such a way that as the press head is rotated with respect to the toothed sleeve in the locking direction, the internal thread can move beyond the external thread, so that the internal thread completely enters into a position corresponding to the second smooth surface, and the external thread completely enters into a position corresponding to the first smooth surface.

In such an anti-loosening emulsion pump with the aforementioned structure, when the press head is rotated in the locking direction, the guide surfaces of the standing tooth blocks and of the standing tooth pieces engage with each other, so that the press head can rotate continuously in the locking direction, and when the press head rotates in the opening direction, the stop surfaces of the standing tooth blocks and of the standing tooth pieces interact with each other, so as to prevent the press head from rotating in the opening direction. Therefore, the anti-loosening emulsion pump can prevent the press head from being open due to such reasons as impact and the like, and can prevent the toothed sleeve from loosening from the opening of the container.

In a specific structure, a height of the first smooth surface is greater than a height of the external thread, and a height of the second smooth surface is greater than a height of the internal thread.

Preferably, the angle formed between the first guide surface and the tangential direction of the press head or of the toothed sleeve is less than the angle formed between the first stop surface and the tangential direction of the press head or of the toothed sleeve; and/or the angle formed between the second guide surface and the tangential direction of the press head or of the toothed sleeve is less than the angle formed between the second stop surface and the tangential direction of the press head or of the toothed sleeve Preferably, a chamfer or bevel is provided at one end of the standing tooth block facing the standing tooth piece. In such a way, when the press head is rotated in the locking direction and pressed downward, the standing tooth piece can slide smoothly beyond the standing tooth block along the chamfer or bevel on the standing tooth block.

Preferably, the anti-loosening emulsion pump includes two or more first standing tooth pieces and two or more first standing tooth blocks, the first standing tooth pieces and the first standing tooth blocks are arranged in such a way that when one of the first sanding tooth pieces contacts with one of the first standing tooth blocks, at least one of the rest of the first standing tooth pieces does not contact any one of the rest of the first standing tooth blocks. In such a way, it can be guaranteed that at least one standing tooth piece does not contact or overlap with any one of the standing tooth blocks, and thus the risk that the standing tooth piece yield because of being pressed for a long time can be reduced.

It can be realized by setting an angle displacement $\alpha_1$ of adjacent first standing tooth pieces and an angle displacement $\alpha_2$ of adjacent first standing tooth blocks in at least one of the following relationships: $\alpha_1 \neq n\alpha_2$; $\alpha_2 \neq n\alpha_1$; $\alpha_1 > n\alpha_2 + \theta$ or $\alpha_1 < n\alpha_2 - \theta$; and $\alpha_2 > n\alpha_1 + \theta$ or $\alpha_2 < n\alpha_1 - \theta$; wherein n is a natural number, $\theta$ is an efficient overlapping angle between the first standing tooth pieces and the first standing tooth blocks.

Alternatively, at least one of the first standing tooth pieces and the first standing tooth blocks may be arranged in irregular spaces along a circumferential direction, and thus the probability that at least one first standing tooth piece does not contact any one of the first standing tooth blocks can be increased.

For example, an angular displacement between one standing tooth piece and an adjacent standing tooth piece at one side thereof can be larger than an angular displacement between the standing tooth piece and an adjacent standing tooth piece at the other side thereof, and the difference between the angular displacements is at least twice of the angular scope taken by one single standing tooth block. Alternatively, this can also be applied to the standing tooth blocks, i.e. an angular displacement between one standing tooth block and an adjacent standing tooth block at one side thereof can be larger than an angular displacement between the standing tooth block and an adjacent standing tooth block at the other side thereof, and the difference between the angular displacements is at least twice of the angular scope taken by one single standing tooth block.

One of at least one second standing tooth piece and at least one second standing tooth block can be respectively provided at a connection between the opening of the container and the toothed sleeve. The working principle of the second standing tooth pieces and the second standing tooth blocks here is identical to that of the first standing tooth pieces and the first standing tooth blocks.

Preferably, the second standing tooth piece and the second standing tooth block are provided in such a way that a torque needed for loosening the toothed sleeve from the container is greater than that needed for loosening the press head from the toothed sleeve, so that the incidence that the toothed sleeve is loosened from the opening of the container prior to the press head is open during rotation of the press head can be prevented.

The specific ways for realizing the aforementioned structure are designing the second standing tooth pieces and the second standing tooth blocks provided between the toothed sleeve and the opening of the containers to be with thicker wall, greater number and/or greater interference amount, or any other means known in the art.

Preferably, the direction for loosening the toothed sleeve from the opening of the toothed sleeve is opposite to the direction for opening the press head from the toothed sleeve. Thus, the function of anti-loosening can be enhanced.

In a more preferable embodiment, an annular sealing plug extends from a lower surface of a flange of the cylinder, an outer diameter of the annular sealing plug is larger than an inner diameter of the opening of the container. Thus, gasket used in the prior art can be omitted, and sealing can be maintained even the toothed sleeve is loosened from the opening of the container in some extent.

Preferably, a chamfer or bevel is provided at a lower portion outside of the annular sealing plug. By providing the chamfer or bevel, insertion of the annular sealing plug into the opening of the container may be facilitated.

In another preferred embodiment, the bore of the piston rod is mounted by an elastic valve, which is mounted into the bore of the piston rod in an interference fit, one end of the elastic valve opens, and the other end is closed by a thin wall provided with a cross shaped slit. The elastic valve can further guarantee the sealing effect of the emulsion pump.

According to another aspect of the present invention, the anti-loosening emulsion pump comprises: a press head including a press mouth; a toothed sleeve connected to an opening of a container mounted with the anti-loosening emulsion pump; a cylinder, an upper end of which is connected to the toothed sleeve and the other end of which extends into the container; a piston rod, an upper end of which is connected to the press head, and a lower end of which extends into a space within the cylinder, with a bore of the piston rod being communicated with an opening of the press mouth; wherein the press mouth is movable relative to a body of the press head.

By means of designing the press mouth movable relative to the body of the press head, the press mouth can move to a position where it is free of torque, and thus the risk of the emulsion pump being loosened and the press mouth being broken can be reduced.

Preferably, the press mouth is mounted on the body of the press head in a telescopic way. Here, a handle is provided on the press mouth, when the press mouth is retracted within the body of the press head, the handle is at least partially exposed.

Alternatively, the press mouth is foldably mounted on the body of the press head. Here, the press mouth is connected to the body of the press head by means of a hinge.

In a further example, the press mouth is detachably mounted on the body of the press head.

BRIEF DESCRIPTION OF THE DRAWINGS

FIGS. 1*a* and 1*b* are sectional views of the emulsion pump of the present invention, in which FIG. 1*a* shows the emulsion pump in a locked state, and FIG. 1*b* shows the emulsion pump in an opening state.

EMBODIMENTS FOR CARRYING OUT THE INVENTION

Figure 1A:
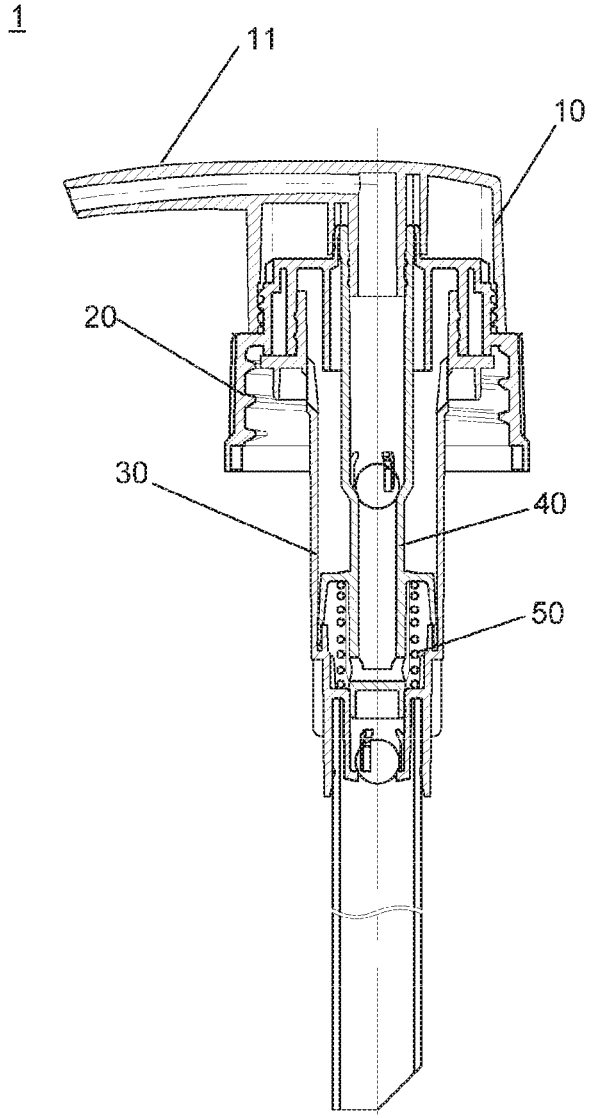

Next, embodiments of the present invention will be described in detail by referring to the drawings. It shall be understood that the drawings only show preferred embodiments for the present invention, which should be explained to limit the scope of the present invention. One skilled in the art can make any obvious modifications, variations, equalities based on the embodiments shown in the drawings, all of which fall within the protective scope of the present invention.

It shall be clarified that the directional terms such as "upper" and "lower" and the like used herein refers to the state that the emulsion pump is put in standing orientation (i.e. the emulsion pump is put with its axis direction being identical to the standing direction).

Figure 1B:
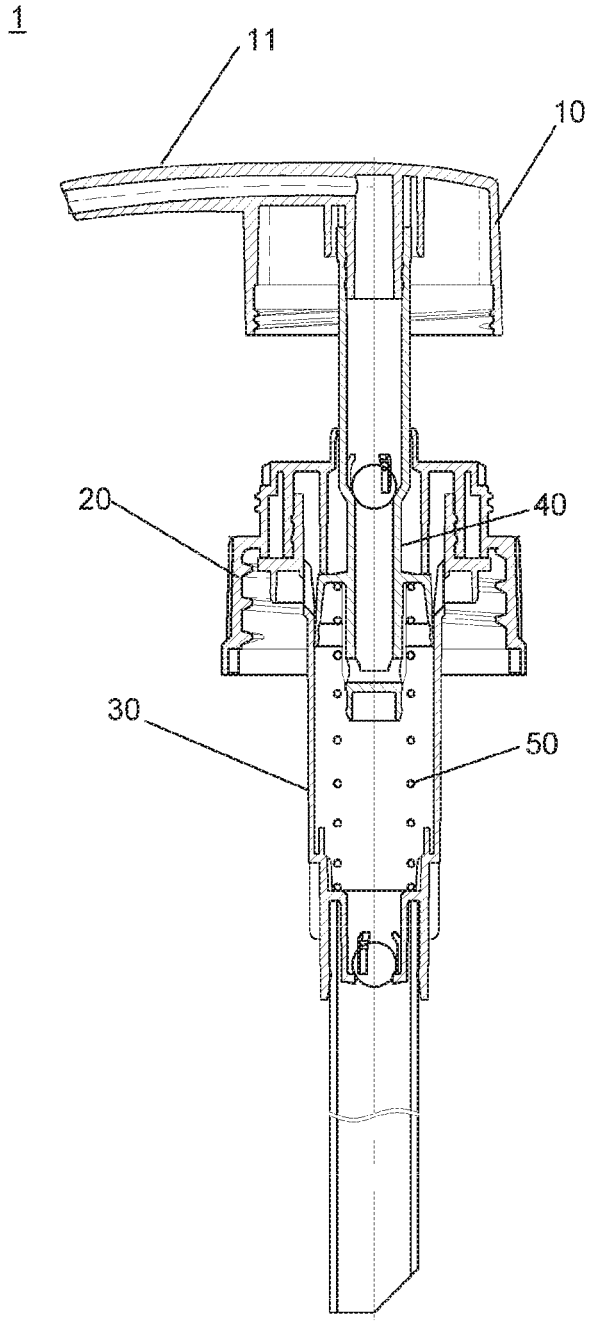

FIGS. 1*a* and 1*b* show longitudinal sectional views of an emulsion pump 1 of the present invention. FIG. 1*a* shows the emulsion pump 1, in which a press head 10 is in a locked position, and FIG. 1*b* shows the emulsion pump 1, in which the press head 10 is in an opening position.

As shown in FIGS. 1*a* and 1*b*, the emulsion pump 1 includes a press head 10, a toothed sleeve 20, a cylinder 30 and a piston rod 40. An upper end of the cylinder 30 is connected to the toothed sleeve 20, and a lower end thereof extends into a container 2 (see FIG. 8*a*). An upper end of the piston rod 30 is connected to the press head 10, and a lower end thereof extends into the space in the cylinder 30, and an inner space of the piston rod 40 communicates with an outlet of a press mouth 11 on the press head 10. A spring 50, which exerts an upward force on the piston rod 40, is provided between the cylinder 30 and the piston rod 40.

Figure 2A:
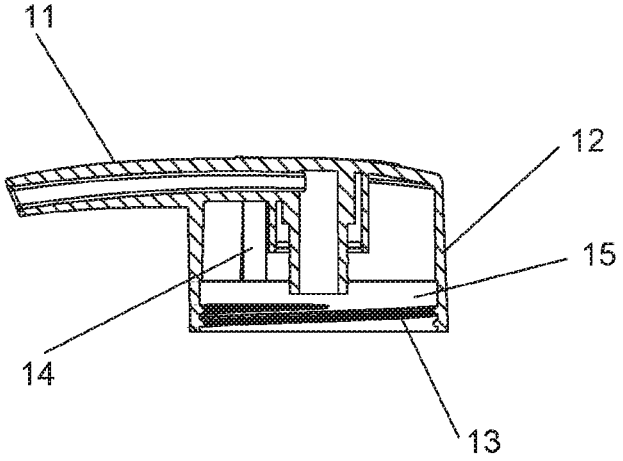
FIG. 2*a* shows a sectional view of the press head of the emulsion pump of the present invention.
Figure 2B:
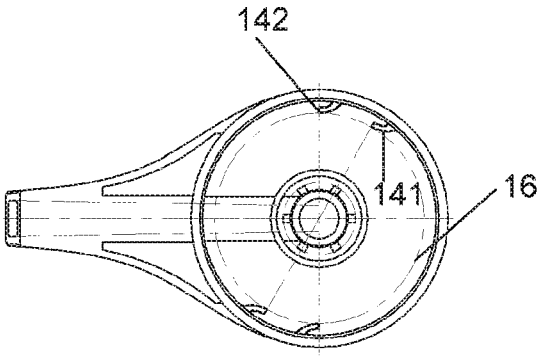
FIG. 2*b* shows a bottom view of the press head.
Figure 2C:
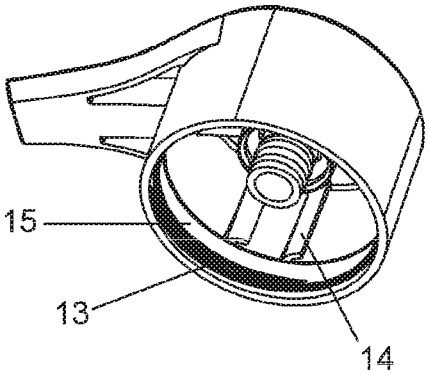
FIG. 2*c* shows a perspective view of the press head.
Figure 3A:
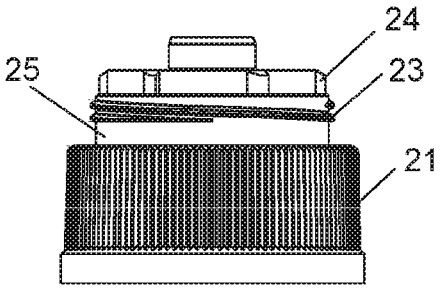
FIG. 3*a* shows a front view of the toothed sleeve of the emulsion pump of the present invention.
Figure 3B:
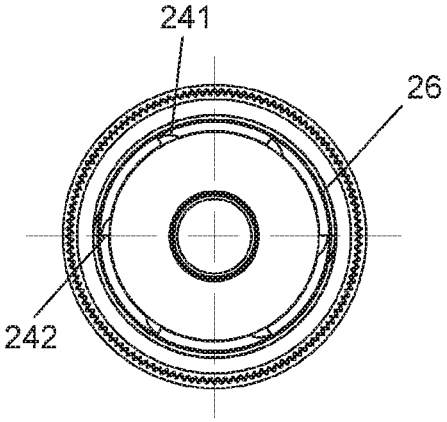
FIG. 3*b* shows a top view of the toothed sleeve.
Figure 3C:
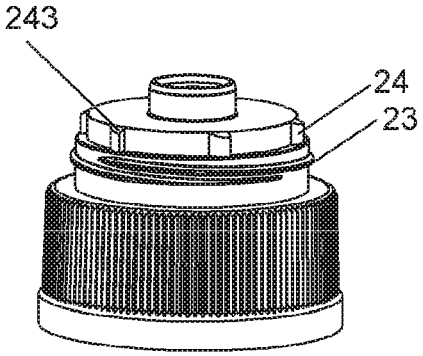
FIG. 3*c* shows a perspective view of the toothed sleeve.
Figure 3D:
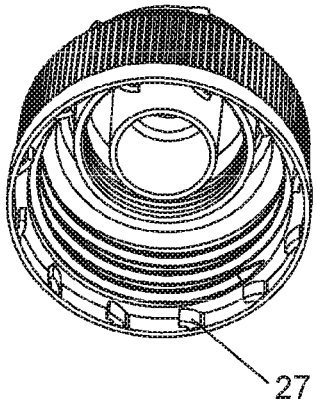
FIG. 3*d* shows a bottom view of the toothed sleeve.

FIGS. 2*a* to 2*c* show the press head 10 of the emulsion pump 1 of the present invention, in which FIG. 2*a* is a sectional view, FIG. 2*b* is a bottom view and FIG. 2*c* is a perspective view. FIGS. 3*a* to 3*d* show the toothed sleeve 20 of the emulsion pump 1 of the present invention, in which FIG. 3*a* is a front view, FIG. 3*b* is a top view, FIG. 3*c* is a perspective view and FIG. 3*d* is a bottom perspective view.

As shown in FIG. 2*a*, the press head 10 includes a press head sleeve 12 and a press mouth 12 extending from the press head sleeve. An internal thread 13 and at least one standing tooth piece 14 are provided on an inner surface of the press head sleeve. The standing tooth piece 14 includes a guide surface 141 and a stop surface 142. The guide surface 141 extends from the inner surface of the press head sleeve in an opening direction of the press head 10, and forms an angle with a tangential direction of the press head 10. The stop surface 142 is provided on a side of the standing tooth piece 14 opposite to the guide surface 141. The angle formed between the guide surface 141 and the tangential direction of the press head 10 is smaller than that formed between the stop surface 142 and the tangential direction of the press head 10.

Correspondingly, as shown in FIG. 3*a*, an external thread 23 and at least one standing tooth block 24 are provided on an outer surface of the toothed sleeve 20. The standing tooth block 24 also includes a guide surface 241 and a stop surface 242. The guide surface 241 of the standing tooth block 24 extends from the outer surface of the toothed sleeve in a locking direction of the press head, and forms an angle with the tangential direction of the toothed sleeve 20. The stop surface 242 of the standing tooth block 24 is provided on a side of the standing tooth block 24 opposite to the guide surface 241. The angle formed between the guide surface 241 and the tangential direction of the toothed sleeve 20 is smaller than that formed between the stop surface 242 and the tangential direction of the stop surface toothed sleeve 20.

It shall be explained that the press head 10 and the toothed sleeve 20 are coaxially mounted, so the tangential direction of the press head 10 and the tangential direction of the toothed sleeve 20 are generally consistent with each other.

FIG. 2*b* shows an inscribed circle 16 of the standing tooth piece 14 of the press head 10 in dash dot line, and FIG. 3*b* shows a circumcircle 26 of the standing tooth block 24 of the toothed sleeve 20. In the present invention, the radius of the inscribed circle 16 is less than that of the circumcircle 26. Thus, when the press head 10 rotates with respect to the toothed sleeve 20 into a position in which the standing tooth piece 14 contacts with the standing tooth block 24, an interference fit is generated between the standing tooth piece 14 and the standing tooth block 24.

Figure 4A:
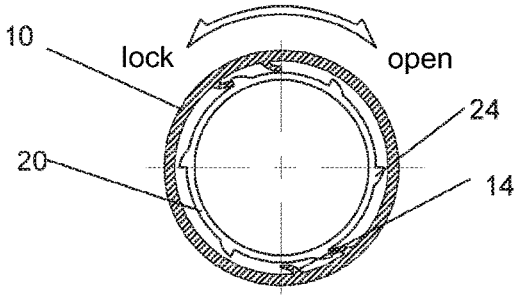
FIGS. 4*a*-4*d* show sectional views at a connection between the press head and the toothed sleeve, which schematically show engagement between standing tooth pieces in the press head and standing tooth blocks in the toothed sleeve.
Figure 4B:
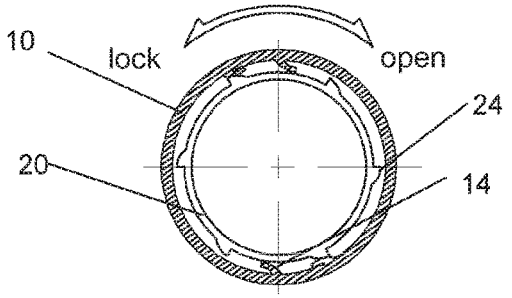
Figure 4C:
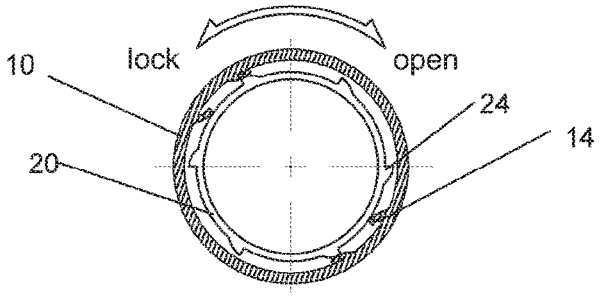
Figure 4D:
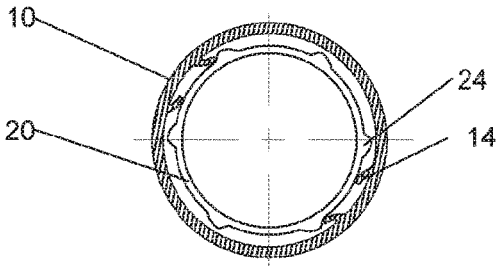

As shown in FIGS. 4*a* to 4*d*, by means of the standing tooth piece 14 and the standing tooth block 24 provided according to the aforementioned structure, when the press head 10 is rotated in the locking direction, the guide surface 141 of the standing tooth piece 14 of the press head 10 and the guide surface 241 of the standing tooth block 24 of the toothed sleeve 20 moves towards each other. At this time, the standing tooth piece 14 elastically deforms by means of the interaction between the guide surface 141 and the guide surface 241, so that the standing tooth piece 14 can move beyond the standing tooth block 24, as shown in FIGS. 4*b* to 4*c*. Further, when the press head 10 is rotated in the opening direction, the stop surface 142 of the standing tooth piece and the stop surface 242 of the standing tooth block move towards each other, and interfere with each other, thus stopping the press head further rotating, as shown in FIGS. 4*a* and 4*d*. The press head 10 can further rotate to open only when a greater torque sufficient to destroy the standing tooth piece 14 is further exerted on the press head 10.

Therefore, during transportation, if a torque in locking direction is exerted on the press head 10, the guide surfaces 141 and 241 move towards each other, so that the standing tooth piece 14 can move beyond the standing tooth block 24, thus the press head 10 may be idling with respect to the toothed sleeve 20.

Further, if a torque in opening direction is exerted on the press head 10 due to impact or drop during transportation, there is a stop action between the stop surfaces 142 and 242 each other, and the torque at this time is commonly insufficient to destroy the standing tooth piece 14, thus the press head 10 may be prevented from opening.

As shown in FIGS. 2*a* and 3*a*, the inner surface of the press head sleeve 12 is further provided with a smooth surface 15, and the outer surface of the toothed sleeve 20 is further provided with a smooth surface 25. The height of the smooth surface 15 is set as h1, and the height of the internal thread 13 is set as h2. The height of the external thread 23 is set as H1, and the height of the smooth surface 25 is set as H2.

By setting the structure and size of the internal thread 13, the external thread 23 and the smooth surfaces 15, 25, the press head 10 may be idling with respect to the toothed sleeve 20 when is exerted with a torque in the locking direction. Specifically, the height h1 of the smooth surface 15 on the press head 10 is set to be greater or equal to the height H1 of the external thread 23 on the toothed sleeve 20, and the height h2 of the internal thread 13 on the press head 10 is set to be less or equal to the height H2 of the smooth surface 25 on the toothed sleeve 20. In such a way, a "tooth skipping" structure may be formed between the press head 10 and the toothed sleeve 20. Specifically, when the press head 10 is pressed downward and rotated with respect to the toothed sleeve 20 in the locking direction, the internal thread 13 of the press head 10 meshes with the external thread 23 of the toothed sleeve 20. With the press head 10 continues to rotate, the internal thread 13 may completely enter into the smooth surface 25 in the toothed sleeve 20, while the external thread 23 may completely enter into the smooth surface 15 of the press head 10. Therefore, the press head 10 may be allowed to further be idling in the locking direction with respect to the toothed sleeve 20.

Figure 5:
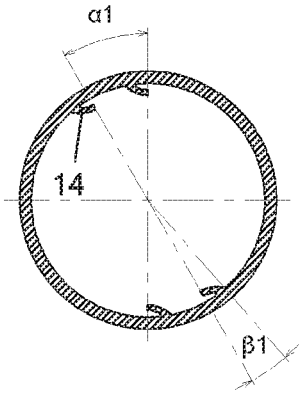
FIG. 5 shows a sectional view of the press head, in which standing tooth pieces provided at an inner surface of the press head sleeve are presented.

Preferably, the number of the standing tooth piece 14 on the press head 10 is two or more. In such a case, an angular displacement between two adjacent standing tooth pieces can be properly selected, so that when one standing tooth piece 14 contacts with the standing tooth block 24 on the toothed sleeve 20, at least one of the rest standing tooth pieces will not contact any one of the rest standing tooth blocks. For example, the angular displacement $\alpha_1$ between two adjacent standing tooth pieces 14 (see FIG. 5) can be set different from the angular displacement $\alpha_2$ between two adjacent standing tooth blocks 24 on the toothed sleeve 20 (see FIGS. 6*a* and 6*b*), and the integer multiple of the angle $\alpha_1$ is also different from the integer multiple of the angle $\alpha_2$. In addition, if the angular scope taken by each standing tooth piece 14 is set as $\beta_1$ (FIG. 4) and the angular scope taken by each standing tooth block is set as 132 (FIG. 5), the aforementioned angle $\alpha_1$ shall be larger than the angle 132, and the angle $\alpha_2$ shall be larger than the angle $\beta_1$. Further, assuming that the efficient contact angle between the standing tooth piece and the standing tooth block is set as $\theta$, that is, there is an angle at which the standing tooth piece and the standing tooth block at least partially contact each other, then the angle $\alpha_1$ shall be beyond the scope of an angle $\alpha_2 \pm \theta$.

Alternatively, at least one of the standing tooth piece 14 and the standing tooth block 25 is distributed in irregular spaces, and thus the probability that at least one standing tooth piece 14 does not contact with any one of the standing tooth blocks 24 can be increased as well. For example, an angular displacement between one standing tooth piece and an adjacent standing tooth piece at one side thereof can be larger than an angular displacement between the one standing tooth piece and an adjacent standing tooth piece at the other side thereof, and the difference between these angular displacements is twice of the angular scope taken by one single standing tooth block, i.e. 2132, or more.

The aforementioned arrangements for the standing tooth piece 14 and for the standing tooth block 24 can be interchanged, i.e. the description on the standing tooth piece can be applied to the standing tooth block, and the description on the standing tooth block can also be applied to the standing tooth piece.

In such a way that the standing tooth piece 14 and standing tooth block 24 are arranged, it can be guaranteed that at least one standing tooth piece 14 will not yield due to being pressed by the standing tooth block 24 for a long time, and thus maintain the stop function of the standing tooth piece 14.

Figure 6A:
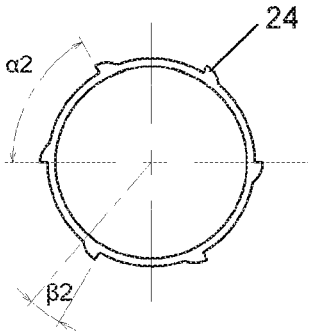
FIGS. 6*a* and 6*b* show sectional views of the toothed sleeve, in which two forms of standing tooth blocks provided on an outer surface of the toothed sleeve are shown, respectively.
Figure 6B:
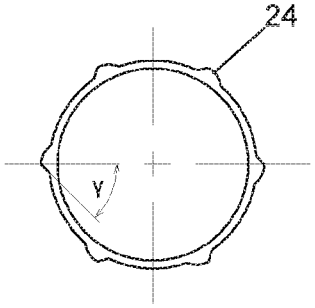

The stop surface 242 of the standing tooth block 24 can radially extend along the toothed sleeve 20 (as shown in FIG. 6*a*), or can form an angle γ, which is less than 90°, with respect to the radial direction of the toothed sleeve 20 (as shown in FIG. 6*b*).

During the press head 10 is locked on the toothed sleeve 20, the press head 10 is pressed downward along the axis while rotating the press head 10 horizontally. In cooperation with the downward movement of the press head 10, a chamfer or bevel 243 is provided on an upper end, i.e. an end facing the standing tooth piece 14, of the standing tooth block 24 of the toothed sleeve 20, as shown in FIG. 3*c*. With the chamfer or bevel 243, when the standing tooth piece 14 contacts with the standing tooth block 24, the standing tooth piece can smoothly slide over the standing tooth block along the chamfer or bevel on the standing tooth block.

In the aforementioned structure, the standing tooth piece is provided on the press head 10, and the standing tooth block is provided on the tooth sleeve 20. The standing tooth piece and the standing tooth block may be interchanged, i.e. the standing tooth block may be provided on the press head 10, and the standing tooth piece may be provided on the toothed sleeve 20, which can also realize the object of the present invention.

In aforementioned structure, the standing tooth block 24 is provided on the toothed sleeve 20, but it may be also provided on a cylinder head of the cylinder 30 as well.

Figure 7A:
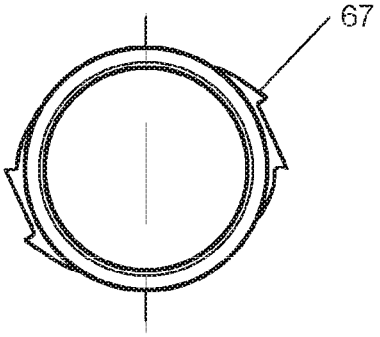
FIG. 7*a* shows a top view at a container opening.
Figure 7B:
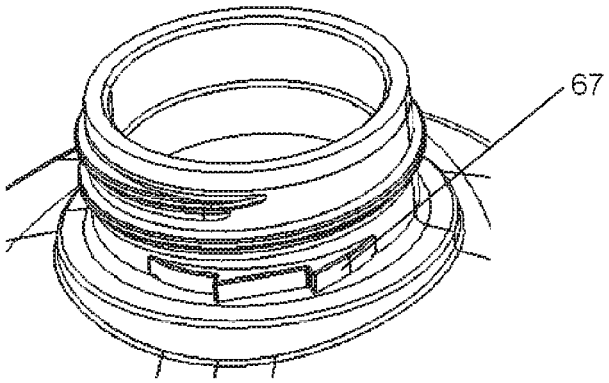
FIG. 7*b* shows a perspective view at the container opening.
Figure 8A:
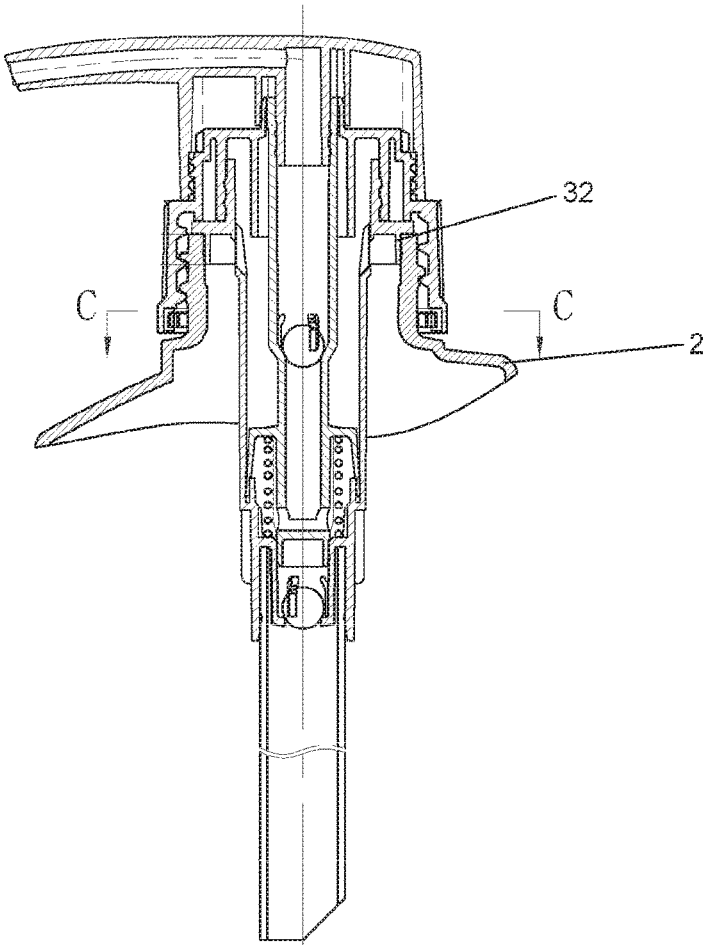
FIG. 8*a* shows a sectional view in a state that the emulsion pump connects with the opening of the container.
Figure 8B:
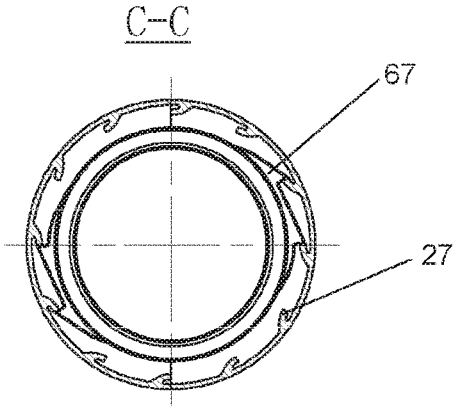
FIG. 8*b* is a sectional view taken along Line C-C in FIG. 8*a*.

Furthermore, as shown in FIG. 3*d*, at least one second standing tooth piece 27 is provided on a bottom portion of the inner surface of a toothed sleeve tube 21 of the toothed sleeve 20. Corresponding thereto, a second standing tooth block 67 is provided on the opening of the container 2, as shown in FIGS. 7*a* and 7*b*. The connection structure between the toothed sleeve 20 and the opening of the container 2 is shown in FIGS. 8*a* and 8*b*, from which it can be seen that the arrangement and the principle of the second standing tooth piece 27 and the second standing tooth block 67 are substantially identical to those of the aforementioned standing tooth piece 14 and the standing tooth block 24, which can prevent the toothed sleeve 20 from accidently loosening from the opening of the container 2.

The aforementioned structure and arrangement of the standing tooth piece 14 and standing tooth block 24 can also be applied to the second standing tooth piece 27 and the second standing tooth block 67.

Furthermore, the torque needed for loosening the toothed sleeve from the opening of the container is preferably greater than the that needed for opening the press head from the toothed sleeve, and thus preventing the incident that the toothed sleeve is released from the opening of the container prior to opening the press head when rotating the press head. To this end, at least one of the following measures can be taken: designing the standing tooth piece and standing tooth block at the connection between the toothed sleeve and the container to be with thicker wall, greater number and/or more interference than the standing tooth piece and the standing tooth block at the connection between the press head and the toothed sleeve. In addition, other means known in the art may be used.

Besides, in order to improve the sealing efficiency, the direction of loosening the toothed sleeve from the opening of the container is set to be opposite to the direction of opening the press head from the toothed sleeve. For example, if the press head is to be rotated in clockwise direction for opening the press head from the toothed sleeve, the toothed sleeve can be loosened from the opening of the container by rotating the toothed sleeve in counter clockwise direction, and on the contrary, if the opening direction of the press head is counter clockwise direction, the toothed sleeve will be loosened from the opening of the container by rotating the toothed sleeve in clockwise direction.

The advantage of such an arrangement is that the sealing performance of the container can be further guaranteed. The principle is that when the press head 10 is rotated in the locking direction, it corresponds to the opening direction of the toothed sleeve 20 and the container 2, and because the press head 10 can be idling with respect to the toothed sleeve 20, no torque will be applied to the connection portion between the toothed sleeve 20 and the opening of the container 2. If the press head 10 is rotated in the opening direction, it corresponds to the locking direction between the toothed sleeve 20 and the container 2, at this time, although the torque is transferred to the connection portion between the toothed sleeve 20 and the opening of the container 2 due to the stop effect between the standing tooth piece 14 and the standing tooth block 24, its effect is to further tighten the toothed sleeve 20 with the container 2, so no leakage will be caused.

Figure 9A:
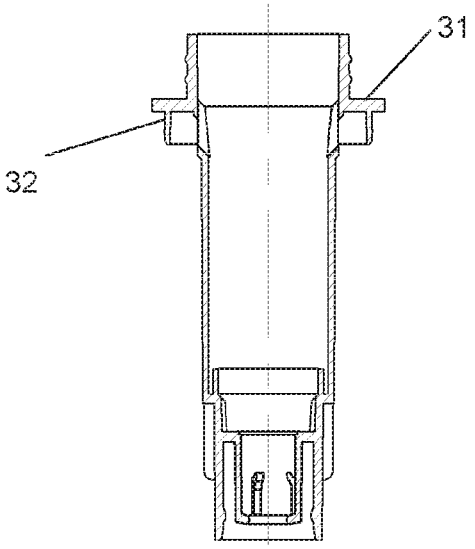
FIG. 9*a* shows a sectional view of the cylinder of the emulsion pump of the present invention.
Figure 9B:
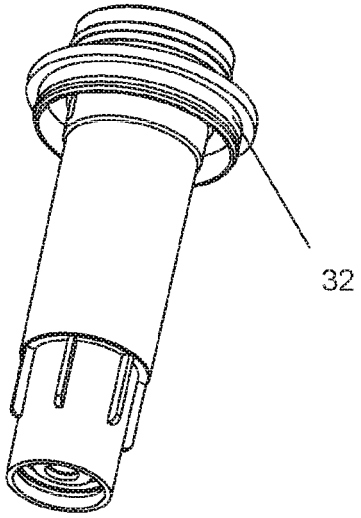
FIG. 9*b* shows a perspective view of the cylinder.

FIGS. 9*a* and 9*b* respectively show a sectional view and a perspective view of the cylinder 30. As shown in FIG. 9*a*, an annular sealing plug 32 extends downward from the lower surface of a cylinder flange 31. An outer diameter of the annular sealing plug 32 is slightly larger than the diameter of the opening of the container 2. In such a way, when the toothed sleeve 20 and the cylinder 30 connected together are mounted onto the opening of the container, the annular sealing plug 32 is inserted into the opening of the container, and interference fit with the opening of the container, and thus serves an function of sealing the container, as shown in FIG. 8*a*. In addition, a chamfer or bevel is provided at a lower portion of outer side of the annular sealing plug 32, and thus facilitates in fitting the annular sealing plug 32 into the opening of the container.

With the annular sealing plug 32 provided, gaskets for sealing can be omitted, and thus the number of the components can be reduced. Also, since the sealing between the sealing plug and the opening of the container is a side surface sealing, and it has a certain length, leakage can also be prevented even the toothed sleeve is somewhat loosened from the opening of the bottle.

Figure 10:
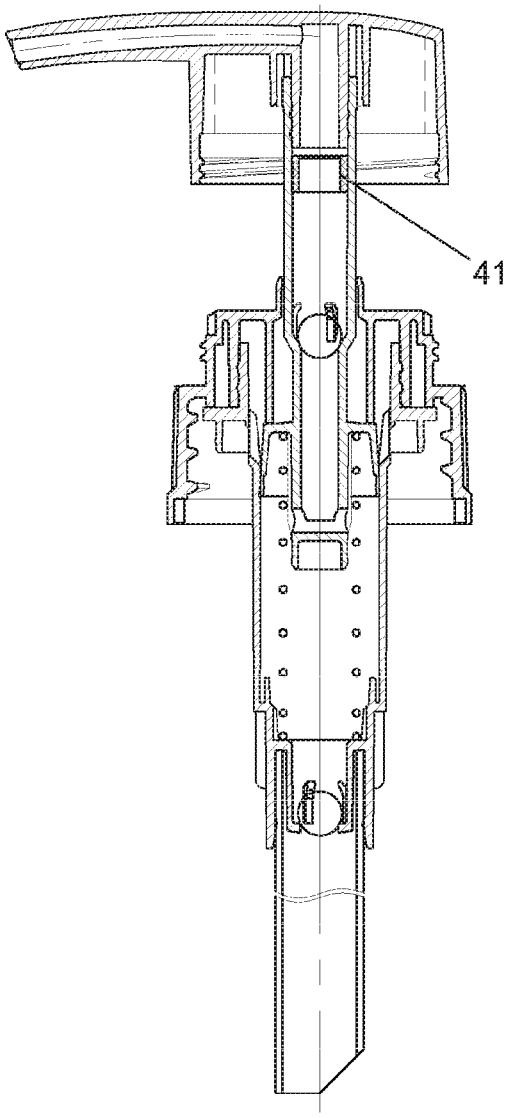
FIG. 10 shows a sectional view of the emulsion pump of the present invention, in which an elastic valve is provided in a bore of the piston rod.
Figure 11A:
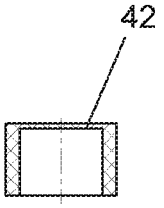
FIG. 11*a* shows a sectional view of the elastic valve.
Figure 11B:
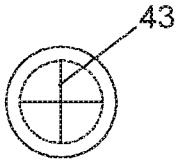
FIG. 11*b* shows a top view of the elastic valve.

As shown in FIG. 10, an elastic valve 41 is provided at an upper portion of the bore of the piston rod 40. The outer diameter of the elastic valve 41 is slightly larger than the diameter at the upper portion of the bore of the piston rod 40. In such a way, the elastic valve 41 is pressed to fit in the bore of the piston rod 40. As shown in FIG. 11*a*, the elastic valve 41 is in a cylinder shape, with its lower end open, and the upper end thereof is closed by a thin wall 42. It can be seen from the top view shown in FIG. 11*b* that a cross shaped slit 43 is formed on the thin wall 42 at the upper end of the elastic valve 41. The cross shaped slit 43 is closed in its normal state, and the cross shaped slit 43 opens only when the differential pressure between two sides of the thin wall 42 is large enough, so that the liquid in the container can flow out.

By providing the elastic valve 41, when the container is laid, the elastic valve will not open because the differential pressure between the two sides of the thin wall 42 is not large enough, thus leakage of liquid from the container may be prevented.

The inventor of the present invention also contemplates solving the technical problem of preventing loosening of the present invention with the structure of the press mouth 11 of the press head 10.

Figure 12A:
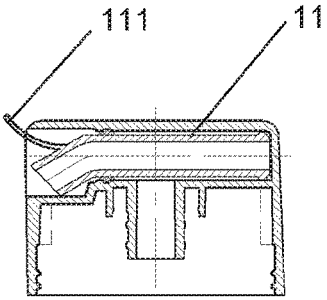
FIGS. 12*a* and 12*b* show sectional views of the press head with a telescopic press mouth.
Figure 12B:
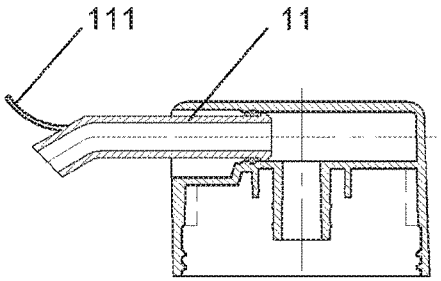
Figure 13A:
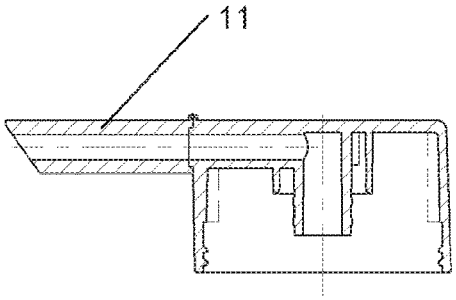
FIGS. 13*a* to 14*b* show sectional views of the press head with a foldable press mouth.
Figure 13B:
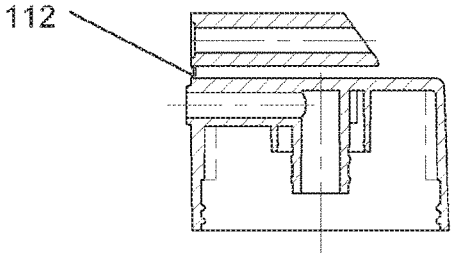

As shown in FIGS. 12*a* and 12*b*, the press mouth 11 on the press head 10 is provided in a telescopic form. During transportation, the press mouth can be retracted within the press head 10, as shown in FIG. 12*a*. During usage, the press mouth can be pulled out directly for use. A handle 111 may be provided at a front portion of the press mouth 11, which is partially exposed when the press mouth is retracted within the press head 11, and thus facilitates the user to pull the press mouth 11 out.

Figure 14A:
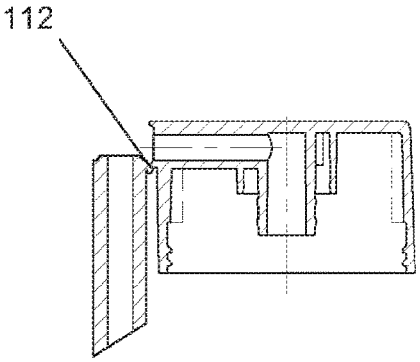
Figure 14B:
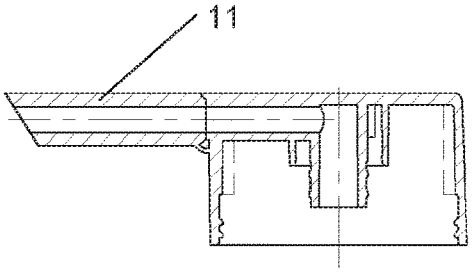

As shown in FIGS. 13*a*-14*b*, the press mouth 11 may be made to be foldable, such as being foldable upward (FIGS. 13*a* and 13*b*) or downward (FIGS. 14*a* and 14*b*). The press mouth 11 connects to the press head 10 by means of a hinge 112.

Figure 15A:
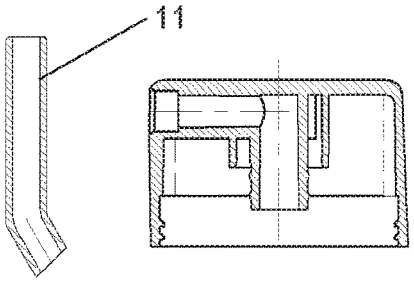
FIGS. 15*a* and 15*b* show sectional views of the press head with a separate press mouth.
Figure 15B:
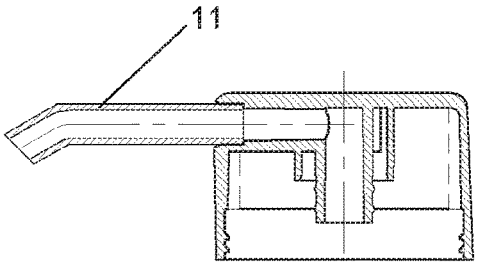
Figure 16A:
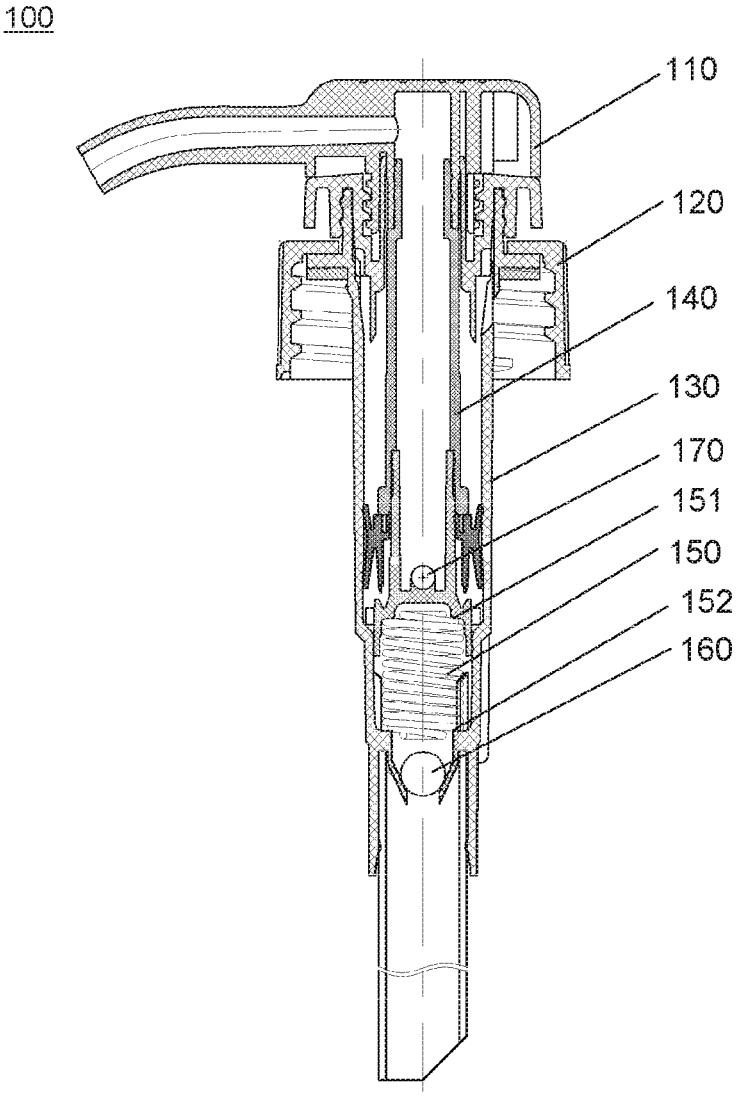
FIG. 16*a* is a sectional view of an emulsion pump in the prior art.
Figure 16B:
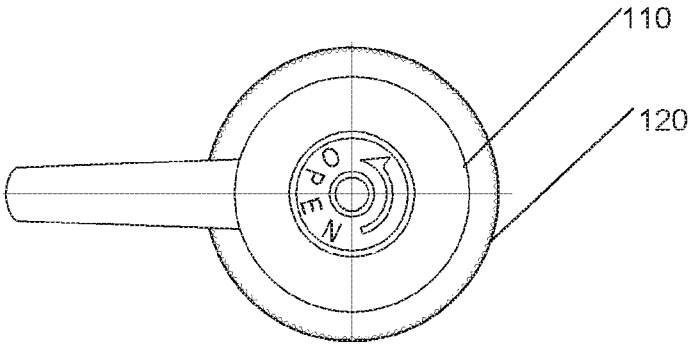
FIG. 16*b* is a top view of the emulsion pump shown in FIG. 16*a*.

As shown in FIGS. 15*a* and 15*b*, the press mouth 11 of the press head 10 is provided in a separate form. As shown in FIG. 15*a*, during transportation, the press mouth 11 may be separated from the press head 10. When used, the press mouth 11 can be inserted into a corresponding hole provided in the press head 10 for use.

The aforementioned telescopic, foldable or separate design for the press mouth 11 allows for the press mouth being free of torque during transportation, and thus the risk of the press head 10 being loosened from the toothed sleeve 20 may be reduced. In addition, such provisions may also reduce the risk of the press mouth 11 being broken.

The invention claimed is:

1. An anti-loosening emulsion pump, the anti-loosening emulsion pump comprising:

a press head including a press mouth;

a toothed sleeve connected to an opening of a container mounted with the anti-loosening emulsion pump;

a cylinder, an upper end of which is connected to the toothed sleeve, and the other end of which extends into the container;

a piston rod, an upper end of which is connected to the press head, and a lower end of which extends into a space within the cylinder, with a bore of the piston rod being communicated with an outlet of the press mouth;

at least one first standing tooth piece provided at one of an inner surface of a press head sleeve of the press head and an outer surface of the toothed sleeve, which includes a first guide surface extending from the one of the inner surface of the press head sleeve and the outer surface of the toothed sleeve in an opening direction of the press head and forming an angle with a tangential direction of the press head or of the toothed sleeve, and a first stop surface provided at a side of the first standing tooth piece opposite to the first guide surface and forming an angle with the tangential direction of the press head or of the toothed sleeve; and at least one first standing tooth block provided at the one of the inner surface of the press head sleeve of the press head and the outer surface of the toothed sleeve, which includes a second guide surface extending from the other one of the inner surface of the press head sleeve and the outer surface of the toothed sleeve in a locking direction of the press head and forming an angle with the tangential direction of the press head or of the toothed sleeve, and a second stop surface provided at a side of the first standing tooth block opposite to the first guide surface and forming an angle with the tangential direction of the press head or of the toothed sleeve, wherein a radius of an inscribed circle of the first standing tooth piece is less than a radius of a circumcircle of the first standing tooth block, thereby an interference fit is formed between the first standing tooth piece and the first standing tooth block; and wherein an internal thread and a first smooth surface are provided on an inner surface of the press head sleeve of the press head, an external thread and a second smooth surface are provided on the outer surface of the toothed sleeve, the internal thread, the external thread, the first smooth surface and the second smooth surface are provide in such a way that as the press head is rotated with respect to the toothed sleeve in the locking direction, the internal thread can move beyond the external thread, so that the internal thread completely enters into a position corresponding to the second smooth surface, and the external thread completely enters into a position corresponding to the first smooth surface.

2. The anti-loosening emulsion pump of claim 1, wherein a height of the first smooth surface is greater than a height of the external thread, and a height of the second smooth surface is greater than a height of the internal thread.

3. The anti-loosening emulsion pump of claim 1, wherein at least one of:

the angle formed between the first guide surface and the tangential direction of the press head or of the toothed sleeve is less than the angle formed between the first stop surface and the tangential direction of the press head or of the toothed sleeve; and the angle formed between the second guide surface and the tangential direction of the press head or of the toothed sleeve is less than the angle formed between the second stop surface and the tangential direction of the press head or of the toothed sleeve.

4. The anti-loosening emulsion pump of claim 1, wherein the anti-loosening emulsion pump includes two or more first standing tooth pieces and two or more first standing tooth blocks, the first standing tooth pieces and the first standing tooth blocks are arranged in such a way that when one of the first standing tooth pieces contacts with one of the first standing tooth blocks, at least one of the rest of the first standing tooth pieces does not contact any one of the rest of the first standing tooth blocks.

5. The anti-loosening emulsion pump of claim 4, wherein an angle displacement $\alpha_1$ of two adjacent first standing tooth pieces and an angle displacement $\alpha_2$ of two adjacent first standing tooth blocks satisfy at least one of the following relationships:

$\alpha_1 \neq n\alpha_2$;

$\alpha_2 \neq n\alpha_1$;

$\alpha_1 > n\alpha_2 + \theta$ or $\alpha_1 < n\alpha_2 - \theta$; and $\alpha_2 > n\alpha_1 + \theta$ or $\alpha_2 < n\alpha_1 - \theta$, wherein n is a natural number and $\theta$ is an efficient overlapping angle at which the first standing tooth pieces and the first standing tooth blocks are at least in partial contact with each other between the first standing tooth pieces and the first standing tooth blocks.

6. The anti-loosening emulsion pump of claim 4, wherein at least one of the first standing tooth pieces and the first standing tooth blocks are arranged in irregular spaces along a circumferential direction.

7. The anti-loosening emulsion pump of claim 6, wherein at least one of:

a difference between an angular displacement from one of the first standing tooth pieces to an adjacent standing tooth piece at one side of the one of the first standing tooth pieces and an angular displacement from the one of the first standing tooth pieces to an adjacent standing tooth piece at the other side of the one of the first standing tooth pieces is larger or equal to twice of the angular scope taken over by one of the first standing tooth blocks; and a difference between an angular displacement from one of the first standing tooth blocks to an adjacent standing tooth block at one side of the one of the first standing tooth blocks and an angular displacement from the one of the first standing tooth blocks to an adjacent standing tooth block at the other side of the one of the first standing tooth blocks is larger or equal to twice of the angular scope taken over by one of the first standing tooth pieces.

8. The anti-loosening emulsion pump of claim 1, wherein a chamfer or bevel is provided at one end of the standing tooth block facing the standing tooth piece.

9. The anti-loosening emulsion pump of claim 1, wherein the toothed sleeve is further provided with one of at least one second standing tooth piece and at least one second standing tooth block, and the opening of the container is provided correspondingly with an other one of at least one second standing tooth piece and at least one second standing tooth block.

10. The anti-loosening emulsion pump of claim 9, wherein the second standing tooth piece and the second standing tooth block are provided in such a way that a torque needed for loosening the toothed sleeve from the container is greater than that needed for loosening the press head from the toothed sleeve.

11. The anti-loosening emulsion pump of claim 10, wherein the first standing tooth piece, the first standing tooth block, the second standing tooth piece and the second standing tooth block satisfy at least one of:

a wall thickness of the first standing tooth piece is less than a wall thickness of the second standing tooth piece;

a wall thickness of the first standing tooth block is less than a wall thickness of the second standing tooth block;

a number of the first standing tooth pieces is less than a number of the second standing tooth pieces;

a number of the first standing tooth blocks is less than a number of the second standing tooth blocks; and an interference amount of the interference fit between the first standing tooth pieces and the first standing tooth blocks is less than an interference amount of the interference fit between the second standing tooth pieces and the second standing tooth blocks.

12. The anti-loosening emulsion pump of claim 1, wherein the direction for loosening the toothed sleeve from the opening of the toothed sleeve is opposite the direction for opening the press head from the toothed sleeve.

13. The anti-loosening emulsion pump of claim 9, wherein the direction for loosening the toothed sleeve from the opening of the toothed sleeve is opposite the direction for opening the press head from the toothed sleeve.

14. The anti-loosening emulsion pump of claim 1, wherein an annular sealing plug extends from a lower surface of a flange of the cylinder and an outer diameter of the annular sealing plug is larger than an inner diameter of the opening of the container.

15. The anti-loosening emulsion pump of claim 14, wherein a chamfer or bevel is provided at a lower portion outside of the annular sealing plug.

16. The anti-loosening emulsion pump of claim 1, wherein an elastic valve is mounted in the bore of the piston rod, the elastic valve is mounted into the bore of the piston rod in a way of interference fit, one end of the elastic valve opens, and the other end thereof is closed by a thin wall provided with a cross shaped slit.

17. The anti-loosening emulsion pump of claim 1, wherein the press head further includes a body, the press mouth being movable relative to the body of the press head.

18. The anti-loosening emulsion pump of claim 17, wherein the press mouth is mounted on the body of the press head in a telescopic way.

19. The anti-loosening emulsion pump of claim 18, wherein a handle is provided on the press mouth, when the press mouth is retracted within the body of the press head, the handle is at least partially exposed.

20. The anti-loosening emulsion pump of claim 17, wherein the press mouth is foldably mounted on the body of the press head.

21. The anti-loosening emulsion pump of claim 20, wherein the press mouth is connected to the body of the press head by a hinge.

22. The anti-loosening emulsion pump of claim 17, wherein the press mouth is detachably mounted on the body of the press head.

* * * * *